US007597581B2

(12) United States Patent
Trout et al.

(10) Patent No.: US 7,597,581 B2
(45) Date of Patent: Oct. 6, 2009

(54) SINGLE USE SECURITY MODULE MEZZANINE CONNECTOR

(75) Inventors: David A. Trout, Lancaster, PA (US); James L. Fedder, Etters, PA (US); Attalee S. Taylor, Palmyra, PA (US); Jason E. Vrenna, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/751,730

(22) Filed: May 22, 2007

(65) Prior Publication Data

US 2008/0293264 A1 Nov. 27, 2008

(51) Int. Cl.
*H01R 13/58* (2006.01)

(52) U.S. Cl. ..... 439/475; 439/66; 439/474

(58) Field of Classification Search ..... 439/474–475, 439/66, 74–75, 710
See application file for complete search history.

(56) References Cited

U.S. PATENT DOCUMENTS 4,386,314 A * 5/1983 Becker ..... 324/110
4,482,937 A * 11/1984 Berg ..... 361/789
5,167,513 A * 12/1992 Johnson et al. ..... 439/78
5,484,295 A 1/1996 Mowry et al.
6,102,731 A 8/2000 Daoud
6,152,747 A 11/2000 McNamara
7,131,849 B2 11/2006 Nishimura et al.
7,470,129 B2 * 12/2008 Trout et al. ..... 439/74
2005/0020103 A1 1/2005 Spink, Jr.
2005/0196987 A1 9/2005 Shuey et al.
2005/0287834 A1 12/2005 Nishimura et al.
2006/0046525 A1 3/2006 Mark
2007/0264857 A1 * 11/2007 Kearby et al. ..... 439/301

* cited by examiner

*Primary Examiner*—Edwin A. Leon
*Assistant Examiner*—Vanessa Girardi

(57) ABSTRACT

A connector including a housing and a contact is disclosed for electrically connecting a first electrical device to a second electrical device across the contact in such a manner that the contact is broken if the connector is removed from the second electrical device. The contact includes a press-fit connection that may be either a compliant eye-of-the-needle or a cylindrical tail.

18 Claims, 9 Drawing Sheets

SINGLE USE SECURITY MODULE MEZZANINE CONNECTOR

FIELD OF THE INVENTION

The present invention relates to electrical connectors. More specifically, the present invention relates to mezzanine-style electrical connectors for connecting a first electrical component to a second electrical component.

BACKGROUND OF THE INVENTION

Electrical connectors provide signal and power connection between electronic devices using signal and power contacts supported within a connector housing. For example, computers and other electronic devices often may include a plurality of interconnected printed circuit boards (PCBs) connected by electrical connectors. It is common for a computer to have a motherboard and one or more other boards that execute or perform specialized operations or tasks. These specialized boards are often referred to as daughter cards. Connections between such PCBs allow for the transfer of power between boards, and/or for the transfer of information, such as data transfer or control signals.

For board-to-board PCB mounting, it is important that the boards be physically separated, yet electrically connected. It is also important that the boards be mechanically supported to prevent excessive movement of the boards. A housing that contains the electrical contacts often serves as this support.

The connector may be attached to a first PCB, which may be a daughter card, by connecting one end of the contacts exposed on one side of the connector to electrical points on a surface of the first circuit board. This connection may be made by soldering or other known attachment methods including, but not limited to solder ball attachment, through hole soldering, and solder paste attachment, so as to permanently attach the connector to the first PCB. The connector is then attached to a second circuit board, which may be a motherboard. The connection to the second PCB may be made by press-fitting contacts of the connector into connective through holes of the second PCB. In such a manner, the connector provides an electrical connection as well as a physical support between the two circuit boards. Since the connector is press-fit to the second PCB, the first PCB may be removed, along with the connector, from the second PCB.

It may be important to provide security measures to prohibit or deter the first PCB from being removed and reused. At this time, no practical method has been developed to render inoperative a first PCB when removed from a second PCB.

Furthermore, no practical method has been developed to more broadly render at least one electrical device inoperative when electrically connected to a second electrical device and the first electrical device with the connector attached is removed.

Therefore, there is an unmet need to provide a connector for electrically connecting a first electrical device to a second electrical device in a manner such that if the electrical devices are physically and electrically separated, the connector, which is attached to the first electrical device, is rendered inoperative and cannot be re-mated.

Furthermore, there is an unmet need to provide a connector for electrically connecting a first PCB to a second PCB in a manner such that if the PCBs are physically and electrically separated, the connector, which is attached to the first PCB, is rendered inoperative and cannot be re-mated.

SUMMARY OF THE INVENTION

An electrical connector including a housing and at least one contact for providing an electrical connection between a first electrical device and a second electrical device is disclosed. The first electrical device and the second electrical device include, but are not limited to, printed circuit boards and cables.

In a first embodiment of the electrical connector, the electrical connector includes a housing, and at least one electrical contact supported by the housing, wherein the at least one electrical contact comprises a first end configured to make a first connection with a first electrical device, a second end configured to make a second connection with a second electrical device, and a frangible section disposed between the first end and the second end, and wherein the frangible section is configured to break before either the first connection or the second connection break when a tensile force is applied to the at least one electrical contact by pulling the first electrical device away from the second electrical device.

The first embodiment of the electrical connector further includes wherein the first connection is a solder connection and the second connection is a press-fit connection. The first embodiment additionally includes wherein the second end comprises either a compliant eye-of-the-needle tail or a compliant cylindrical tail.

The first embodiment of the electrical connector also includes wherein the contact provides for either a vertical connection between the first electrical device and the second electrical device or a right-angle connection between the first electrical device and the second electrical device.

The first embodiment of the electrical connector additionally includes wherein the housing comprises a lower ledge that is in contact with a lower push shoulder of the contact having an eye-of-the-needle tail to prevent the contact from moving beyond a predetermined point when inserted into the housing and wherein the housing further comprises an upper ledge spaced apart from an upper shoulder of the contact that permits the frangible section to stretch and break when the tensile force is applied to the contact.

The first embodiment of the electrical connector also includes wherein the housing comprises a lower ledge that is in contact with an upper end surface of the contact tail to prevent the contact from moving beyond a predetermined point when inserted into the housing; and wherein the housing further comprises an upper ledge spaced apart from an upper shoulder of the contact that permits the frangible section to stretch and break when the tensile force is applied to the contact.

In a first embodiment of an electrical contact, the electrical contact includes a body, a lead at a first end of the body, and a tail at a second end of the body opposite from the first end, wherein the body comprises a frangible section capable of breaking the electrical connection between the lead and the tail when a tensile force is applied across the body of the electrical contact between the lead and the tail.

The first embodiment of the electrical contact further includes wherein the lead is a solder connection and the tail is a compliant press-fit connection. The first embodiment of the electrical connector also includes wherein the compliant press-fit connection comprises an eye-of-the-needle tail or a compliant cylindrical tail having a slit and retention barbs.

In a first embodiment of an electrical connector assembly, the electrical connector assembly includes a connector comprising a housing and at least one electrical contact comprising a first end, a second end, and a body comprising a frangible section, a first electrical device connected to the first end at a first connection, and a second electrical device connected to the second end at a second connection, wherein the frangible section is configured to break before either the first connection or the second connection break when a tensile force is applied to the at least one electrical contact by pulling the first electrical device away from the second electrical device. The first electrical device and the second electrical device include, but are not limited to, printed circuit boards and cables.

The first embodiment of the electrical connector assembly further includes wherein the first connection is a permanent connection and the second connection is a press-fit connection. The first connection may be made by soldering or other known attachment methods including, but not limited to solder ball attachment, through hole soldering, and solder paste attachment, so as to permanently attach the connector to the first electrical device. The second connection may be made by a press-fit connection or other known removable connector connection.

The first embodiment of the electrical connector assembly also includes wherein the second end comprises a compliant eye-of-the-needle tail or a compliant cylindrical tail.

The first embodiment of the electrical connector assembly additionally includes wherein the contact provides for either a vertical connection between the first electrical device and the second electrical device or a right-angle connection between the first electrical device and the second electrical device. The first embodiment of the electrical connector assembly also includes wherein the first electrical device is a daughter card and the second electrical device is a motherboard.

Further aspects of the method and system are disclosed herein. The features as discussed above, as well as other features and advantages of the present invention will be appreciated and understood by those skilled in the art from the following detailed description and drawings.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
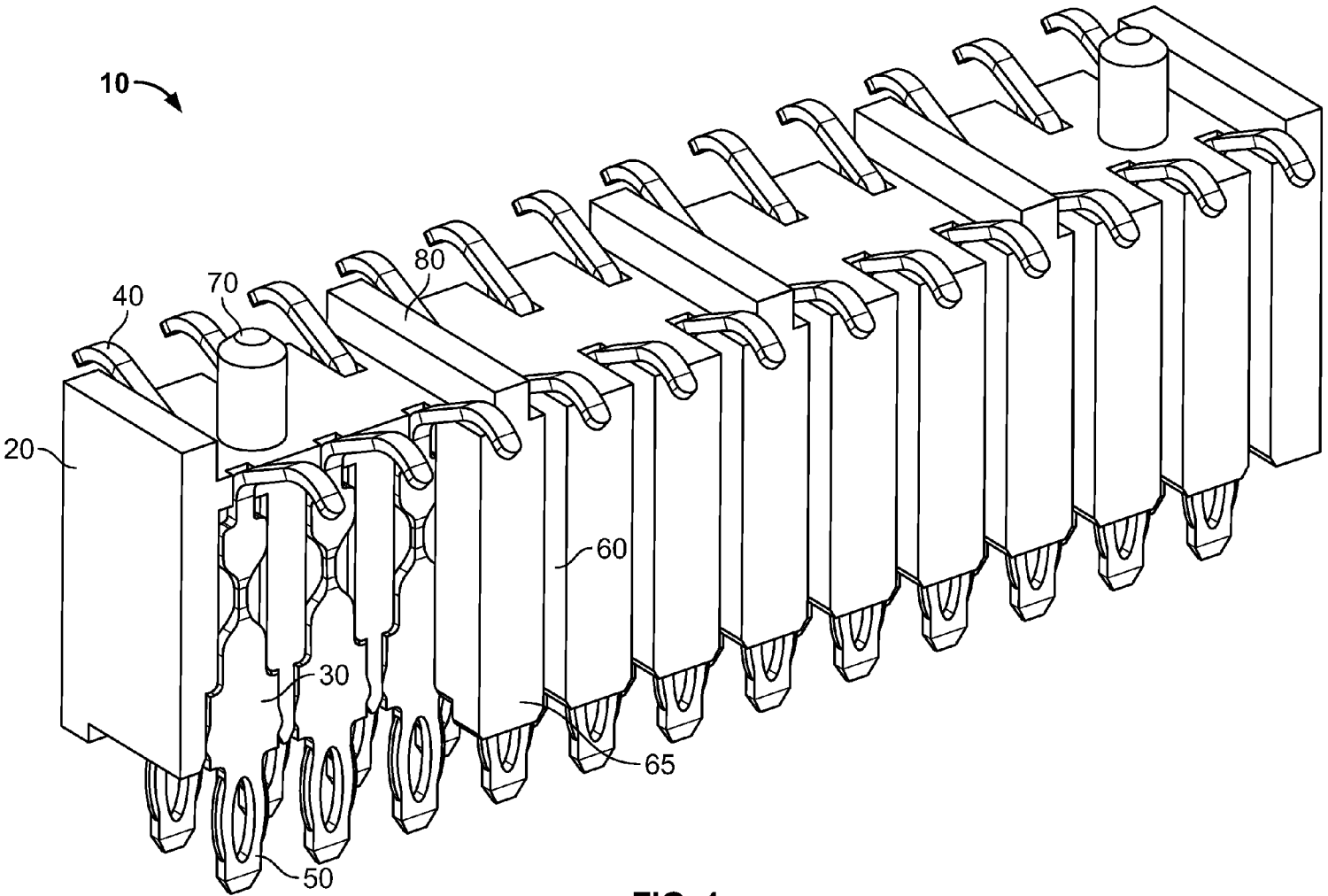
FIG. 1 illustrates an exemplary electrical connector according to a first embodiment of the invention.

Referring to FIG. 1, a first embodiment of the single use security module connector 10 is depicted. The connector 10 includes a housing 20 and contacts 30. Contacts 30 include leads 40 and compliant tails 50. The contacts 30 extend through the housing 20 between the leads 40 and the tails 50. The connector 10 is shown with two rows of contacts 30, however, one or more rows of contacts 30 with one or more contacts per row are within the scope of this invention.

The housing 20 includes slits 60 for allowing the leads 40 to pass through the housing 20 when the contacts 30 are first loaded into the housing 20. The slits 60 are necessary because the leads 40 extend beyond the side face 65 of the housing 20. The housing 20 also includes standoffs 80.

The housing 20 includes alignment posts 70 for aligning the connector 10 with a first electrical device. The housing 20 is shown with two alignment posts 70 on the lead side surface of the housing 20. The posts 70 aligning the housing 20 with a first electrical device such as a printed circuit board (PCB). Although two posts 70 are preferable, it is within the scope of the invention to include additional aligning posts 70 or other alignment structures. Additionally, alignment posts 70 may also be provided on the tail side surface (not shown) of the housing 20.

When the posts 70 are aligned with corresponding alignment holes on a first electrical device, the leads 40 are also aligned with electrical contacts on the surface of the electrical device, for example, surface mount pads on a PCB surface. The PCB may be a daughter card. The standoffs 80 create a space where the leads 40 attach to a first electrical device to facilitate soldering the leads 40 to the device.

Figure 2:
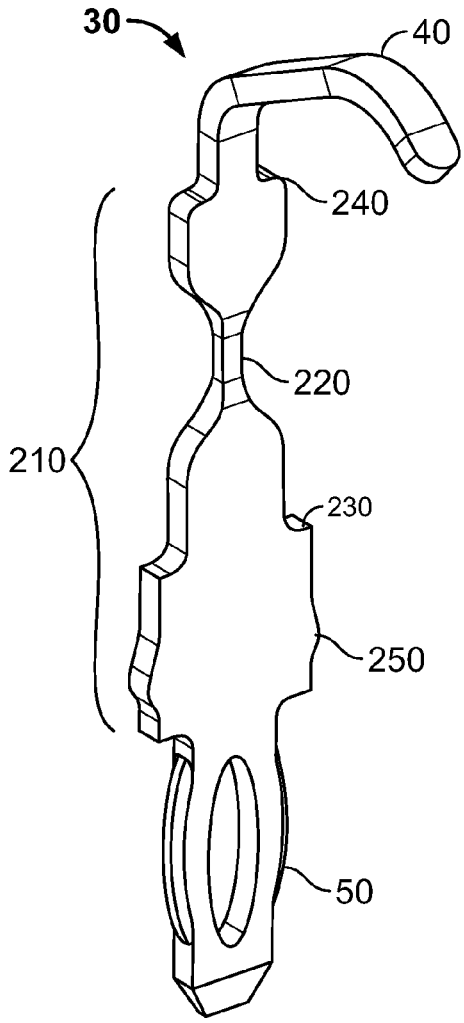
FIG. 2 illustrates a detailed view of an exemplary contact according to a first embodiment of the invention.

A detailed illustration of a first embodiment of a contact 30 is shown in FIG. 2. As shown in FIG. 2, the contact 30 has a lead 40 and a compliant eye-of-the-needle tail 50. The contact 30 is shown with body 210. Contact body 210 includes a frangible section 220, lower push shoulders 230, upper push shoulders 240, and retention shoulders 250. Frangible section 220 is shown as a reduced cross section as compared to the other portions of the contact 30 to allow the contact 30 to first break at this the frangible section 220 when a tensile stress is pulled across the contact 30 between the lead 40 and the tail 50. It should be understood the frangible section 220 may be weakened by either mechanical design or chemical or metallurgical treatment as compared to the other portions of the contact 30 to ensure that the contact 30 is weakest at the frangible section 220. The weakened mechanical design can be formed, for example, by reducing the cross-section, thinning the material, or providing for a weaker material at the frangible section 220.

Figure 7:
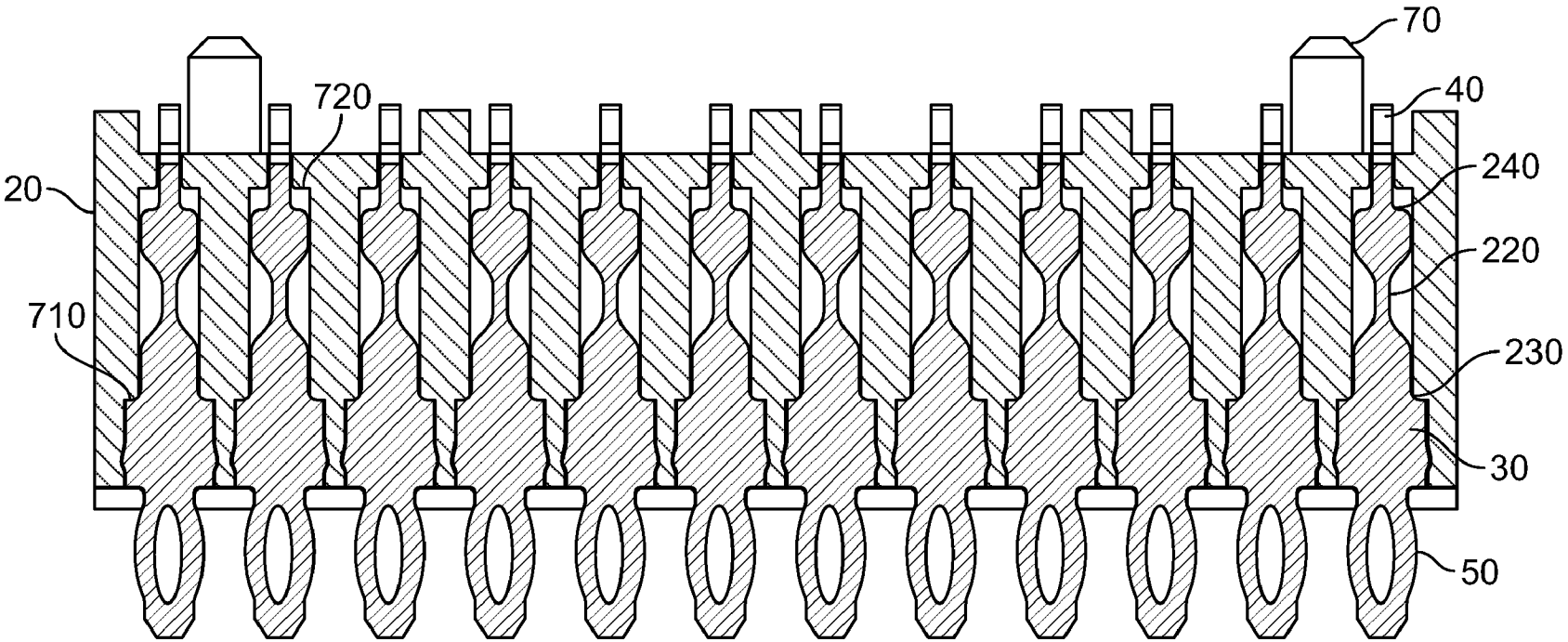
FIG. 7 illustrates a cross-sectional view of the first embodiment of the exemplary connector.

The contact 30 is loaded into the housing 20 by inserting the lead 40 into the slit 60 and pushing the contact 30 into the housing 20 until the lower push shoulder contacts the lower ledge 710 of the housing 20 as shown in FIG. 7. The retention shoulders 250 provide a friction fit with the housing so as to retain the contact 30 within the housing 20.

The compliant eye-of-the-needle tail 50 is configured to resiliently compress when pushed into a through hole or other receiving structure of a second electrical device to form a firm friction fit with good electrical contact.

The frangible section 220 is configured to break under the tensile stress of pulling lead 40 and tail 50 in opposite direction, such as when the lead 40 is attached to a first electrical device and the tail 50 is attached to second electrical device, and the first and second electrical devices are pulled apart. In such a manner, the frangible section 220 will break before the electrical connections between either the lead 40 and the first electrical device or the tail 50 and the second electrical device break. The first electrical device may be a daughter card and the second electrical device may be a motherboard. The lead 40 is configured to be connected to the first electrical device by soldering. The tail 50 is configured to be connected to the second electrical device by a press-fit.

Figure 3:
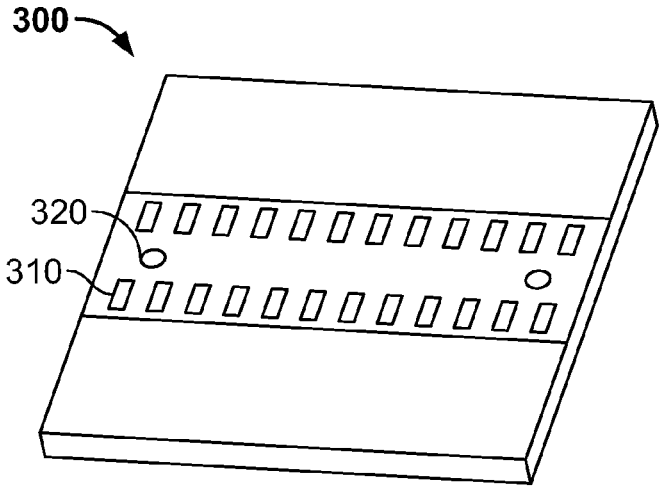
FIG. 3 illustrates an exemplary daughter card.
Figure 4:
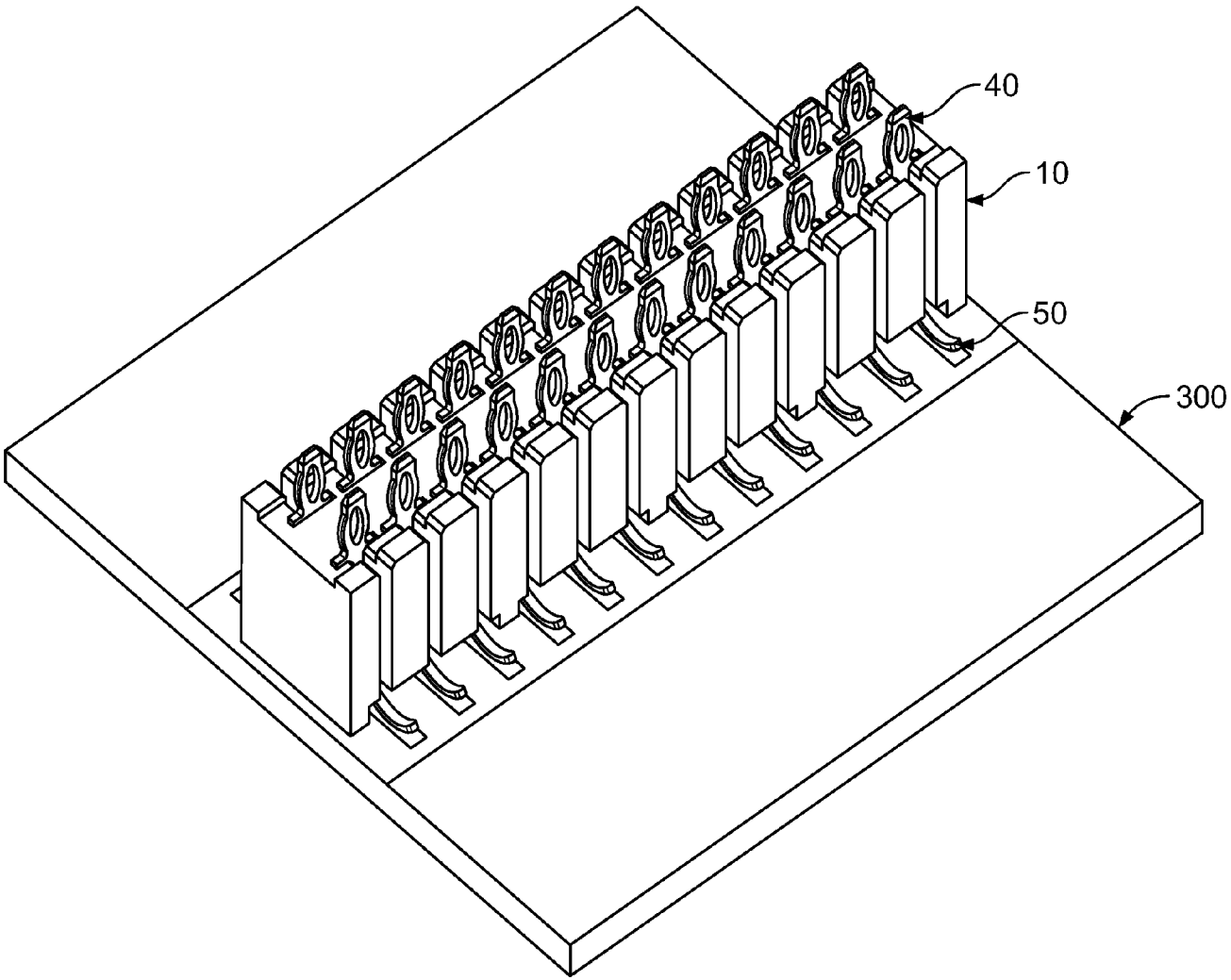
FIG. 4 illustrates an exemplary arrangement of the connector according to the first embodiment connected to an exemplary daughter card.

The leads 40 of contacts 30 of connector 10 may be attached to a first electrical device such as a daughter card. A daughter card 300 having surface mount pads 310 is shown in FIG. 3. The daughter card 300 further includes alignment holes 320. The connector 10 is brought into contact with the daughter card 300 so that the alignment posts 70 are aligned with alignment holes 320 and the leads 40 are positioned against surface mount pads 310. The leads 40 are then soldered to the surface mount pads 310 of a daughter card 300. In such a manner, an electrical connection is established between the leads 40 and the daughter card 300 as shown in FIG. 4.

Figure 5:
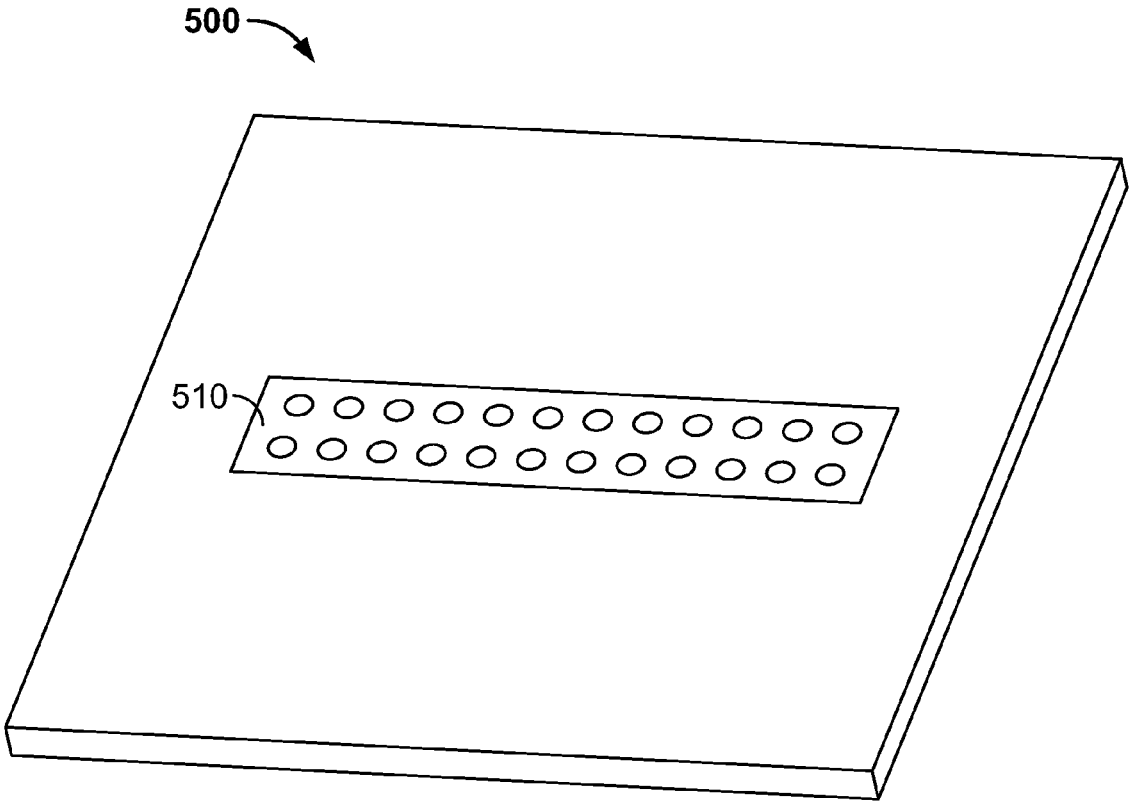
FIG. 5 illustrates an exemplary motherboard.
Figure 6:
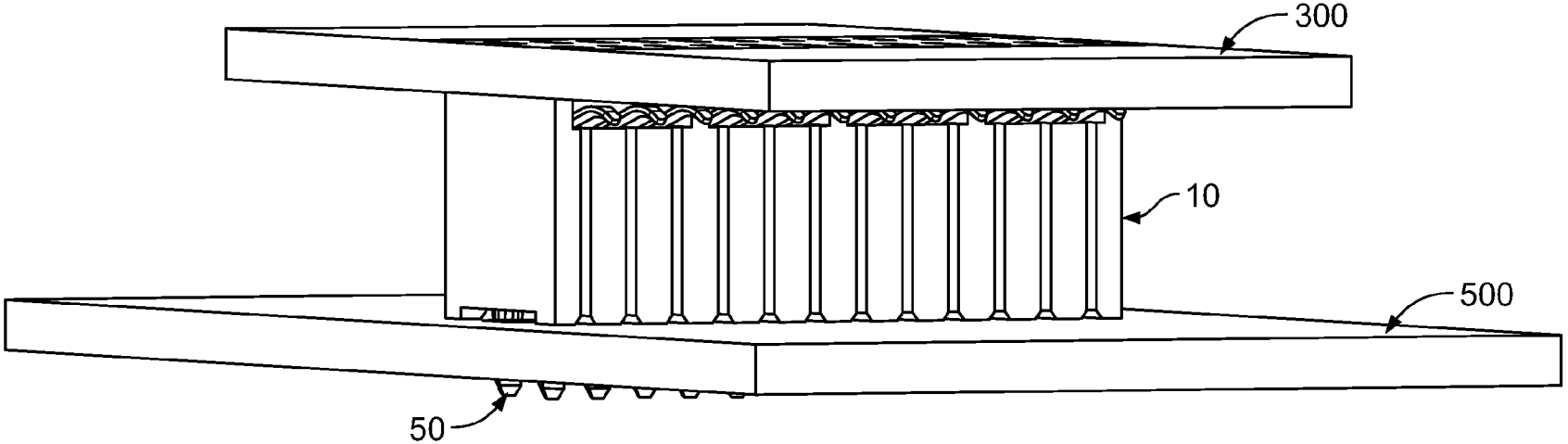
FIG. 6 illustrates an exemplary arrangement of the first embodiment of the connector connecting an exemplary daughter card to an exemplary motherboard.

A motherboard 500 having plated through holes 510 is shown in FIG. 5. After the connector 10 is soldered to daughter card 300, the tails 50 of connector 10 are press-fit into the corresponding plated though holes 510 of a motherboard 500. In such a manner, an electrical connection is established between the motherboard 500 and the daughter card 300 through the connector 10 as shown in FIG. 6. The motherboard 500 may be provided with alignment holes (not shown) when the connector 10 is provided with alignment posts on the tail side of the connector 10.

When the connector 10 is attached to a daughter card 300 and a motherboard 500, by soldering and press-fitting, respectively, the frangible section 220 of the contact 30 is designed to break before the daughter card 300 can be pulled from the motherboard 500. The connector 10 remains attached to daughter card 300 since the force required to break the solder bond between the leads 40 and the pads 310 is much greater than the force required to pull the press-fit tails 50 from the through holes 510. As a result, the daughter card 300 will be pulled away from the motherboard 500 with the connector 10 and the portion of the contact 30 above the frangible section 220 attached. The portion of the contact 30 below the frangible section 220 will remain press-fit in the motherboard 500.

The portion of the contact 30 below the frangible section 220, including the tail 50, may be removed from the motherboard 500 to allow another connector to be connected to the motherboard, however, the press-fitting and removal of the tail scours and scratches the plated through hole. Because of this damage to the through holes, connectors may be removed and replaced on the motherboard up to about three times before the through holes need to be repaired or modified.

After the daughter card 300 is removed from the motherboard 500, the daughter card 300 has the connector housing 20 and the portion of the contact 30 above the frangible section 220 attached thereto. The daughter card 300 cannot be reused in this condition. It may be possible to unsolder the leads 40 from the daughter card 300 so that the daughter card 300 may be reused, but this complex step effectively prohibits reuse of the daughter card 300.

A detailed description of the mechanism of breaking the contact 30 at the frangible section 220 is now provided. A cross-section of connector 10 having a housing 20 and contacts 30 is shown in FIG. 7. Housing 20 includes housing support lower ledges 710 for contacting the lower push shoulders 230 of the contacts 30. The lower ledges 710 prevent further movement of the contact 30 when the compliant tails 50 are press-fit into a second electrical device such as PCB, or more specifically, the motherboard 500.

As further shown in FIG. 7, contact 30 also has upper shoulders 240 that are spaced away from housing upper ledges 720 such that a clearance or space exits between the upper shoulders 240 and upper ledges 720. When leads 40 are attached to a first electrical device and tails 50 are attached to a second electrical device, pulling the first electrical device from the second electrical device will cause the frangible section 220 to stretch in the direction of the upper ledges 720 and break the contact 30 at the frangible section 220. The stretching can occur because of the space between the upper shoulders 240 and the upper ledges 720 directs tensile load at the frangible section 220. The contact 30 is configured to stretch and break at the frangible section 220 before an amount of force necessary to remove the tails 50 from the second electrical device is applied. In such a manner, the contact 30 will break at the frangible section 220 before the connector 10 is removed from the second electrical device. Since the leads 40 are soldered to the first electrical device, the only other way to remove the first electrical device from the second electrical device would be to unsolder the leads 40 from the first electrical device, which in most instances is impractical. This effectively limits the connector 10 to a single use application.

The contacts 30 may be formed of a highly conductive metal or alloy, such as phosphor bronze. The housing 20 may be formed of a high temperature liquid crystalline polymer (LCP) or other known industry acceptable non-conductive high temperature resin.

Figure 8:
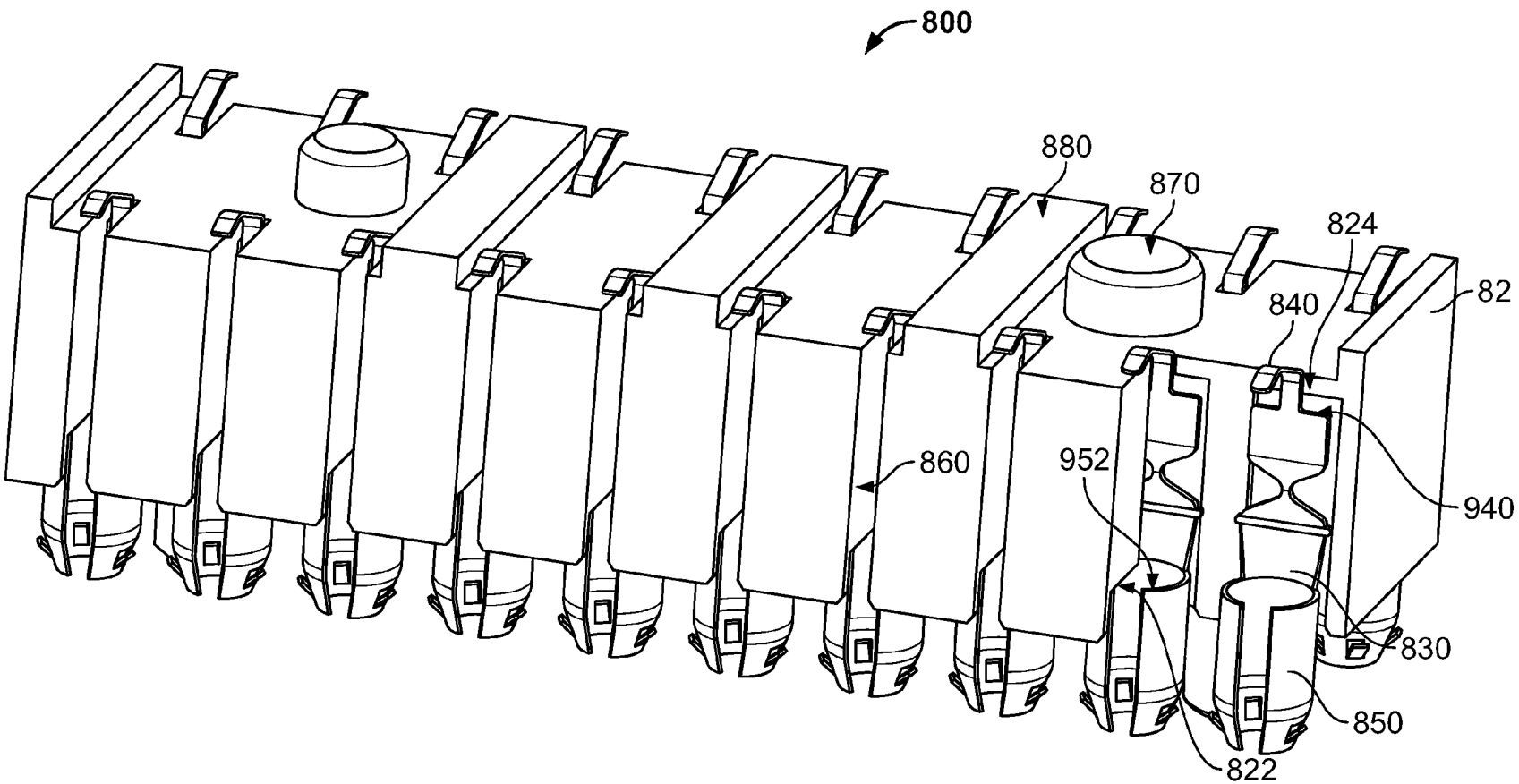
FIG. 8 illustrates an exemplary electrical connector according to a second embodiment of the invention.

FIG. 8 shows an alternative embodiment of a connector 800 that includes housing 820 and contacts 830. Contacts 830 are formed with leads 840 and compliant tails 850. The housing 820 includes slits 860 for allowing leads 840 to pass through the housing 820 when the contacts 830 are first loaded into the housing 820.

The housing 820 also includes alignment posts 870 for aligning the connector 800 with a first electrical device. The housing 820 is shown with two alignment posts 870 on the lead side surface of the housing 820. The posts 870 align the housing 820 with an electrical device such as a printed circuit board (PCB). Although two posts 870 are preferable, it is within the scope of the invention to include additional aligning posts 870 or other alignment structures. Additionally, optional alignment posts 870 may also be provided on the tail side surface of the housing 820.

When the posts 870 are aligned with corresponding alignment holes on a first electrical device, the leads 840 are also aligned with electrical contacts on the surface of the electrical device, for example, surface mount pads on a PCB surface. The PCB may be a daughter card 300. The housing 820 also includes standoffs 880. The standoffs 880 create a space where the leads 840 attach to a first electrical device to facilitate soldering the leads 840 to the device.

Figure 9:
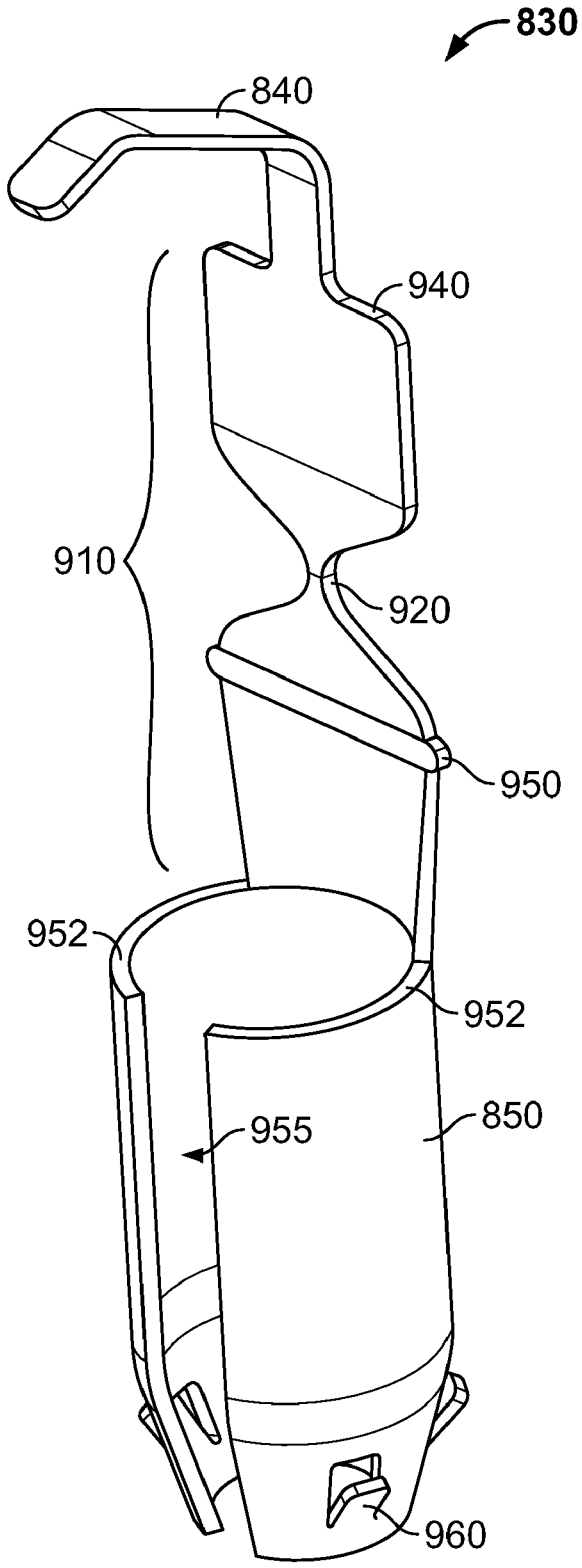
FIG. 9 illustrates an exemplary alternative embodiment of a contact according to the second embodiment of the invention.

Contact 830 is shown in greater detail in FIG. 9. Contact 830 includes a contact body 910, a contact lead 840, and a compliant cylindrical tail 850. Contact body 910 includes a frangible section 920, retention shoulders 950, and upper push shoulders 940. As can be seen in FIG. 8, the retention shoulders 950 frictionally fit within the housing 820 to securely hold the contact 830 within the housing 820.

Frangible section 920 is shown having a reduced cross-section to provide for the contact 930 breaking first at this section when a tensile stress is pulled across the contact 930 between the lead 840 and the tail 850. It should be understood the frangible section 920 may be weakened by either mechanical design or chemical or metallurgical treatment as compared to the other portions of the contact 830 to ensure that the contact 830 is weakest at the frangible section 920. The weakened mechanical design can be formed, for example, by reducing the cross section, thinning the material, or providing for a weaker material at the frangible section 920.

The compliant cylindrical tail 850 includes an upper end surface 952, slot 955 and retention barbs 960. The tail 850 preferably includes at least two barbs 960, and most preferably includes at least three barbs 960. The tail 950 is shown having a cylindrical shape, but other shapes, including square, rectangular and octagonal are within the scope of the invention.

The frangible section 920 is configured to break under the tensile stress of pulling lead 840 and tail 850 in opposite direction, such as when the lead 840 is attached to a first electrical device and the tail 850 is attached to second electrical device, and the first electrical and second electrical devices are pulled apart. In such a manner, the frangible section 920 will break before the electrical connections between either the lead 840 and the first electrical device or the tail 850 and the second electrical device break. The first electrical device may be a daughter card 300 and the second electrical device may be a motherboard 500. The lead 840 is configured to be connected to the first electrical device by soldering.

The tail 850 is configured to be connected to a second electrical device by a press-fit. The slot 955 allows the tail 850 to be compliant, allowing the tail 850 to compress as it is press-fit into the through holes of the second electrical device. The barbs 960 compress during insertion into the through holes and then expand as they exit the through holes upon passing through the second electrical device. The barbs 960 assist in preventing the contact 830 from being removed from the second electrical device without breaking the contact 830.

When the connector 800 is attached to first and second electrical devices, by soldering and press-fit, respectively, the frangible section 920 of the contact 830 is designed to break before the connector 800 can be removed from the second electrical device. As a result, the first electrical device will be pulled away with the connector 800 attached, including the part of the contact 830 above the frangible section 920. The part of the contact 830 below the frangible section 920, including the tail 850, will remain press-fit in the second electrical device.

The portion of the contact 830 remaining in the second electrical device may be removed from the second electrical device by crimping or removing the barbs 960 or by pulling the remaining contact portion from the other side of the electrical device from which it was inserted. After removal of the remaining contact portion, another connector may be connected to the second electrical device. The press-fit of tail 850 scours or scratches the plated through hole of the second electrical device upon press-fitting and may limit the reuse of the second electrical device without further repair.

After the first electrical device is removed from the second electrical device, the first electrical device has the connector housing 820 and the portion of the contact 830 above the frangible section 820 attached thereto. The first electrical device cannot be reused in this condition. It may be possible to unsolder the leads 840 from the first electrical device to allow the first electrical device to be reused, but this difficult and costly step effectively prohibits reuse of the first electrical device.

A detailed description of the mechanism of breaking the frangible section 820 of the alternative embodiment of connector 800 is now provided. As can be seen in FIGS. 8 and 9, housing 820 includes housing support lower ledges 822 for contacting the upper end surface 952 of contacts 830. The lower ledges 822 prevent further movement of contact 830 when tails 850 are press-fit into a second electrical device such as PCB, or more specifically, a motherboard 500.

As can also be seen in FIGS. 8 and 9, contact 830 also has upper shoulders 940 that are spaced away from housing upper ledges 824, creating a clearance or space between the upper push shoulders 940 and upper ledges 824. When leads 840 are attached to a first electrical device and tails 850 are attached to a second electrical device, an attempt to pull the first electrical device from the second electrical device will cause the frangible section 920 to stretch in the direction of the upper ledge 824 and break the contact 830 at the frangible section 920. The stretching can occur because of the space between the upper shoulders 940 and the upper ledges 824. The contact 830 is configured to stretch at the frangible section 920 before an amount of force necessary to remove the tails 950 from the second electrical device is applied. In such a manner, the contact 830 will stretch and break at the frangible section 920 before the connector 800 is removed from the second electrical device. Since the leads 840 are soldered to the daughter card 300, the only other way to remove the first electrical device from the second electrical device would be to unsolder the leads 840 from the first electrical device, which in most instances is impractical. This effectively limits the connector 800 to a single use application.

As can be further seen in FIG. 8, the tails 850 extend into the housing 820. The upper end surfaces 952 contact the lower ledges 822 to prevent the contact 820 from being pushed beyond a predetermined distance into the housing 820. This allows the tail 850 to be pushed into a though hole of a PCB without dislodging the contact 830 within the housing 820.

Figure 10:
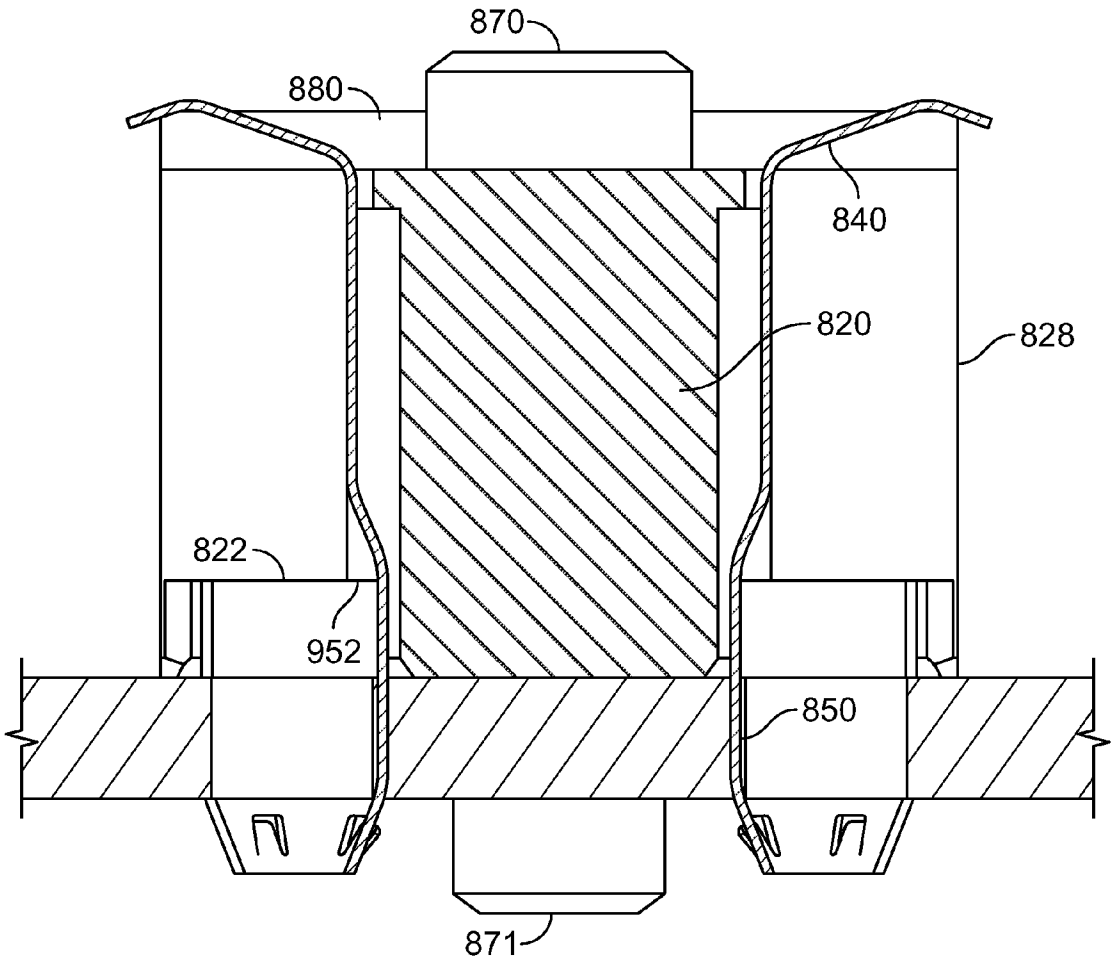
FIG. 10 illustrates an exemplary side sectional view of the electrical connector accordingly to the second embodiment of the invention.

A side cross-sectional view of connector 800 is shown in FIG. 10. As can be seen in FIG. 10, the leads 840 extend beyond the standoffs 880. The leads 840 also extend beyond the sidewall 828 of the housing 820. This facilitates soldering the leads 840 to a first electrical device and allows for visual inspection of the solder joints. FIG. 10 also shows optional lower alignment posts 871.

As in the first embodiment, the leads 840 of connector 800 may be attached to a first electrical device such as a daughter card 300. A daughter card 300 having surface mount pads 310 is shown in FIG. 3. The daughter card 300 further includes alignment holes 320. The connector 800 is brought into contact with the daughter card 300 so that the alignment posts 870 are aligned with alignment holes 320 and the leads 840 are positioned against surface mount pads 310. The leads 840 are then soldered to the surface mount pads 310 of a daughter card 300.

A motherboard 500 having plated through holes 510 is shown in FIG. 5. The motherboard may be provided with optional alignment holes (not shown) to accept optional alignment posts (not shown) of the connector 800. After the connector 800 is electrically connected to daughter card 300, the tails 850 of connector 800 are then inserted into the corresponding though holes 510 of a motherboard 500. In such a manner, an electrical connection is established between the motherboard 500 and the daughter card 300 through the connector 800.

When the connector 800 is attached to a daughter card 300 and a motherboard 500, by soldering and press-fitting, respectively, the frangible section 920 of the contact 830 is designed to break before the daughter card 300 with the connector 800 can be pulled from the motherboard 500. The connector 800 remains attached to daughter card 300 since the force required to break the solder bond between the leads 840 and the pads 310 is much greater than the force required to pull the press-fit tails 850 from the through holes 510. As a result, the daughter card 300 will be pulled away from the motherboard 500 with the connector 800 and the portion of the contact 30 above the frangible section 920 attached. The portion of the contact 830 below the frangible section 920 will remain press-fit in the motherboard 500.

The portion of the contact 830 below the frangible section 920 remaining in the motherboard 500 may be removed from the motherboard by crimping or removing the barbs 960 or by pulling the remaining contact portion from the other side of the motherboard 500 from which it was inserted. After removal of the remaining contact portion, another connector may be connected to the motherboard 500. The press-fit of tail 950 may scour or scratch the plated through hole of the motherboard upon press-fitting and may limit the reuse of the motherboard without further repair.

After the daughter card 300 is removed from the motherboard 500, the daughter card 300 has the connector housing 820 and the portion of the contact 830 above the frangible section 820 attached thereto. The daughter card 300 cannot be reused in this condition. It may be possible to unsolder the leads 840 from the daughter card 300 to allow the daughter card 300 to be reused, but this difficult and costly step effectively prohibits reuse of the daughter card 300.

The contacts 830 may be formed of a highly conductive metal or alloy, such as posphor bronze, or other known industry acceptable contact material. The housing 820 may be formed of a high temperature liquid crystalline polymer (LCP) or other known industry acceptable non-conductive high temperature resin.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector for interconnecting a first electrical device with a second electrical device, the electrical connector comprising:

a housing; and an electrical contact supported by the housing;

wherein the electrical contact comprises a first end configured to make a first connection with the first electrical device, a second end configured to make a second connection with the second electrical device, and a frangible section disposed between the first end and the second end;

wherein the frangible section is configured to break before either the first connection or the second connection break when a tensile force is applied to the electrical contact by pulling the first electrical device away from the second electrical device;

wherein the housing comprises a lower ledge that is in contact with a lower portion of the electrical contact to prevent the electrical contact from moving beyond a predetermined point when the electrical contact is inserted into the housing; and wherein the housing comprises an upper ledge spaced apart from an upper shoulder of the electrical contact to permit the frangible section to stretch and break when the tensile force is applied to the electrical contact.

2. The connector of claim 1, wherein the first end is a solder lead and the second end is a press-fit connection.

3. The connector of claim 2, wherein the second end comprises a compliant eye-of-the-needle tail.

4. The connector of claim 2, wherein the second end comprises a compliant cylindrical tail.

5. The connector of claim 2, wherein the contact provides for a vertical connection between the first electrical device and the second electrical device.

6. The connector of claim 2, wherein the contact provides for a right-angle connection between the first electrical device and the second electrical device.

7. An electrical contact, comprising:

a body configured to be held in a connector housing;

a lead at a first end of the body and configured to make an electrical connection with a first electrical device; and a tail at a second end of the body opposite from the first end and configured to make an electrical connection with a second electrical device;

wherein the body comprises a frangible section that is configured to break when a tensile force is applied across the body of the electrical contact between the lead and the tail;

wherein the housing comprises a lower ledge that is in contact with a lower portion of the body to prevent the body from moving beyond a predetermined point when the body is inserted into the housing; and wherein the housing comprises an upper ledge spaced apart from an upper shoulder of the body to permit the frangible section to stretch and break when the tensile force is applied across the body.

8. The electrical contact of claim 7, wherein the frangible section has a reduced cross-section compared to other portions of the body.

9. The electrical contact of claim 8, wherein the first end is a solder lead and the second end is a press-fit connection.

10. The electrical contact of claim 9, wherein the second end comprises a compliant eye-of-the-needle tail.

11. The electrical contact of claim 9, wherein the second end comprises a compliant cylindrical tail.

12. An electrical connector assembly, comprising:

a connector comprising a housing and an electrical contact held by the housing, the electrical contact comprising a first end, a second end, and a body comprising a frangible section;

a first electrical device connected to the first end at a first connection; and a second electrical device connected to the second end at a second connection;

wherein the frangible section is configured to break before either the first connection or the second connection break when a tensile force is applied to the electrical contact by pulling the first electrical device away from the second electrical device, wherein the housing comprises a lower ledge that is in contact with a lower portion of the electrical contact to prevent the electrical contact from moving beyond a predetermined point when the electrical contact is inserted into the housing; and wherein the housing comprises an upper ledge spaced apart from an upper shoulder of the electrical contact to permit the frangible section to stretch and break when the tensile force is applied to the electrical contact.

13. The assembly of claim 12, wherein the contact provides for a right-angle connection between the first electrical device and the second electrical device.

14. The assembly of claim 12, wherein the first connection is a solder connection and the second connection is a press-fit connection.

15. The assembly of claim 14, wherein the first electrical device is a daughter card and the second electrical device is a motherboard.

16. The assembly of claim 14, wherein the second end comprises a compliant eye-of-the-needle tail.

17. The assembly of claim 14, wherein the second end comprises a compliant cylindrical tail.

18. The assembly of claim 12, wherein the contact provides for a vertical connection between the first electrical device and the second electrical device.

* * * * *